US005437373A

United States Patent [19]

Desmadryl

[11] Patent Number: 5,437,373

[45] Date of Patent: Aug. 1, 1995

[54] AERAULIC SEPARATOR, PARTICULARLY FOR SORTING WASTE

[75] Inventor: Alain Desmadryl, Linselles, France

[73] Assignee: Delta Neu S.A., France

[21] Appl. No.: 180,665

[22] Filed: Jan. 13, 1994

[30] Foreign Application Priority Data

Jan. 26, 1993 [FR] France ..... 93 01117
Dec. 20, 1993 [EP] European Pat. Off. ..... 93490025

[51] Int. Cl.[6] ..... B07B 4/00
[52] U.S. Cl. ..... 209/137; 209/466
[58] Field of Search ..... 209/135–137, 209/143, 151, 474, 466

[56] References Cited

U.S. PATENT DOCUMENTS

| | | | |
|---|---|---|---|
| 1,068,162 | 7/1913 | Payne | 209/466 |
| 2,012,633 | 8/1935 | Meunier | 209/466 |
| 2,161,500 | 6/1939 | Bird et al. | 209/466 |
| 2,275,849 | 3/1942 | Fraser | 209/466 |
| 2,303,367 | 12/1942 | Kendall et al. | 209/466 X |
| 2,358,293 | 9/1944 | Kendall et al. | 209/466 |
| 4,089,422 | 5/1978 | Harmke et al. | 209/137 |
| 4,913,804 | 4/1990 | Muller | 209/466 X |
| 4,915,824 | 4/1990 | Surtees | 209/137 X |

FOREIGN PATENT DOCUMENTS

| | | | |
|---|---|---|---|
| 213076 | 6/1956 | Australia | 209/466 |
| 249775 | 5/1963 | Australia | 209/466 |
| 526823 | 3/1954 | Belgium | 209/466 |
| 0543810 | 6/1956 | Belgium . | |
| 673694 | 1/1930 | France | 209/466 |
| 707394 | 7/1931 | France | 209/466 |
| 711465 | 9/1931 | France | 209/466 |
| 772345 | 10/1934 | France | 209/466 |
| 1123112 | 9/1956 | France . | |
| 1193715 | 11/1959 | France . | |
| 60-61050 | 4/1985 | Japan . | |
| 451804 | 8/1936 | United Kingdom | 209/466 |
| 442835 | 7/1975 | U.S.S.R. | 209/466 |
| 1713682 | 2/1992 | U.S.S.R. | B07B 4/08 |
| 8505049 | 11/1985 | WIPO . | |

*Primary Examiner*—D. Glenn Dayoan
*Attorney, Agent, or Firm*—Ladas & Parry

[57] ABSTRACT

An aeraulic separator for automatically separating materials into three batches of different weights or shapes having a chamber under a slight depression with an inlet opening, two perforated inclined planes with an inclination of angle $\alpha$ and $\beta$,$\beta$ being greater than or equal to $\alpha$, supplied with air under pressure, three outlet openings for the three batches, and a deflector. The heavy materials drop through the first opening adjacent the second inclined plane. The materials of intermediate weight are projected above the deflector and drop in the second opening, while the light materials are sucked through the third opening connected to a suction system. The separator is preferably mounted on a system for vibrating at low frequency and high elongation.

10 Claims, 2 Drawing Sheets

AERAULIC SEPARATOR, PARTICULARLY FOR SORTING WASTE

FIELD OF THE INVENTION

The present invention relates to the separation of materials into more or less homogeneous batches, being particularly intended for sorting waste and dry refuse from selective collections. It relates more particularly to a separator adapted to separate the materials into at least three batches, each batch grouping together materials of substantially homogeneous weight. Such a separator may be used in particular for separating collected multi-material waste, for example glass bottles, plastic, cardboard, paper.

BACKGROUND OF THE INVENTION

The problem that Applicants aim at solving is that of proposing equipment which may automatically and reliably separate materials of different weights or shapes, such separation allowing a grouping into at least three batches, each batch corresponding to the materials having a substantially homogeneous weight.

In the case of an automatic sorting of waste coming from a multi-material collection, it will be question of separating firstly, the heavy materials such as glass bottles or telephone directories, secondly, materials of intermediate weight such as plastic bottles or cardboard and, thirdly, very light materials such as individual sheets of paper or plastic films or even dust residues.

SUMMARY OF THE INVENTION

This object is perfectly attained by the aeraulic separator of the invention which comprises a separation chamber presenting an upper face, a lower face and four lateral faces and which comprises:

a) in the lower part of a first lateral face, an opening for admission of the materials to be separated, b) in the lower face, successively from said first lateral face up to the opposite lateral face:

a first perforated inclined plane with an inclination of angle $\alpha$ with respect to the horizontal, a second perforated inclined plane with an inclination of angle $\beta$ greater than or equal to $\alpha$, a first opening for outlet of the batch corresponding to the heaviest materials, a second opening for outlet of the batch corresponding to the materials of intermediate weight, a first inclined deflector extending above the first outlet opening up to the front edge of the second outlet opening, c) in the upper part of the separation chamber, towards the zone overhanging the first and second outlet openings, a third opening for outlet of the batch corresponding to the light materials, connected to a suction system.

Moreover, the aeraulic separator comprises two air-supply channels, opening out respectively in the perforations of the first and second inclined planes, the density, the dimensions of the perforations of the two inclined planes, the flowrate of air of the two supply channels and of the suction system being such that the materials to be separated, introduced in the separation chamber, move over the two inclined planes and are evacuated respectively via the third outlet opening for the light materials, via the first outlet opening for the heavy materials and via the second outlet opening for the materials of intermediate weight, after these latter have been projected by the air coming from the second supply channel above the first deflector.

The materials to be separated which are introduced via the admission opening move naturally over the first inclined plane. The air coming from the first channel lifts these materials and separates them from one another. The lightest materials are already lifted and entrained towards the third outlet opening thanks to the suction system which creates in the separation chamber a slight depression. The other materials move over the second inclined plane. The air blown through the perforations in said second plane rejects said materials towards the inside of the chamber. The first inclined deflector enables a selection to be made between the heavy materials and the materials of intermediate weight: the heavy materials which have a low trajectory do not reach the lower face of the first deflector and drop in the first outlet opening which said deflector overhangs, whilst the materials of intermediate weight, which have a higher trajectory, pass above the first deflector. In that case, the upper face of the first deflector performs the role of slideway, allowing the materials of intermediate weight to move after having dropped onto said upper face, as far as the second outlet opening.

The density, the dimensions of the perforations of the second inclined plane and the flowrate of air of the corresponding supply channel, are preferably chosen so that the speed of the air flow at the outlet of the second inclined plane is of the order of 50 m/s.

The density, the dimensions of the perforations of the two inclined planes and the flowrate of air of the two supply channels are advantageously chosen so that the speed of the air flow at the outlet of the second inclined plane is about twice the speed of the air flow at the outlet of the first inclined plane.

When angle $\alpha$ of the first inclined plane is very small, i.e. less than or equal to 9°, it is preferable if angle $\beta$ is strictly larger than angle $\alpha$ insofar as Applicants have noticed that, if these two angles had the same value, a certain stagnation of the materials passing from the first to the second inclined plane might be produced. Such stagnation is doubtlessly due to the turbulences provoked locally by the differences in flow velocity of the two air flows leaving the perforations of the two inclined planes. On the interface between the two inclined planes, there is created a barrier effect which may prevent correct displacement of the materials from the first to the second plane.

In order to avoid any risk of stagnation, the angle $\alpha$ of the first inclined plane will be chosen to be greater than 9°, and preferably equal to 15°. In that case, angle $\beta$ of the second inclined plane may advantageously be equal to angle $\alpha$, with the result that the first and second inclined planes may be constituted by a single inclined plane.

In order to avoid any risk of accidental evacuation of the waste of intermediate weight via the third opening, the aeraulic separator further comprises a second deflector which is positioned in the separation chamber, in a zone overhanging the second inclined plane and the first opening, and located between the first deflector and the third opening. This second deflector forms an obstacle to the materials of intermediate weight which are lifted by the air flow passing through the second inclined plane, and makes it possible to redirect these materials towards the upper face of the first deflector.

In order to promote displacement of the materials to be separated over the inclined planes, as well as over the upper face of the first deflector, the separator preferably comprises vibration means adapted to communicate to the separation chamber a vibration at low frequency and high elongation.

Such vibration means may consist in springs on which the separation chamber is placed and in two eccentric shafts rotating in opposite direction and driven by brake motors, said shafts being fast with the lateral faces of the chamber on either side of the inlet opening.

Vibration at low frequency and high elongation promotes individualization of the materials after they have been introduced via the inlet opening in the separation chamber and also their displacement along the planes and the first inclined deflector.

As the materials to be separated include glass bottles, the front end of the first deflector preferably overhangs the rear end of the second inclined plane at a distance of about 150 mm. Thanks to this particular arrangement, it is possible to sort the glass bottles which, not being projected above the first deflector, necessarily pass in the space located between said deflector and the second inclined plane and drop in the first outlet opening. This result is obtained with virtually perfect reliability which allows an extremely exhaustive selective sorting.

BRIEF DESCRIPTION OF THE DRAWINGS

The invention will be more readily understood on reading the following description with reference to the accompanying drawings, in which.

BRIEF DESCRIPTION OF THE INVENTION

Figure 1:
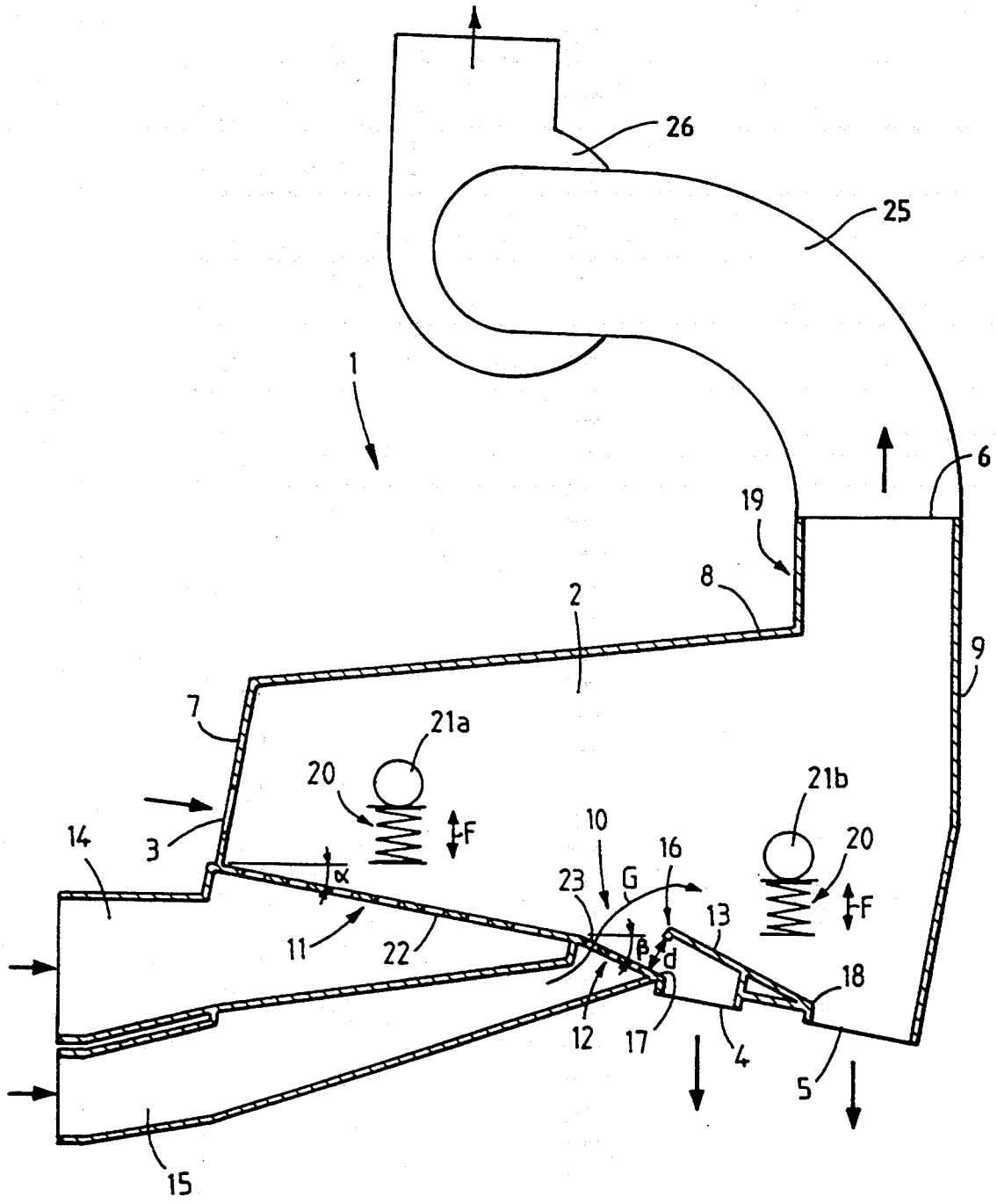
FIG. 1 schematically shows a first particular embodiment of a vibrated aeraulic separator in which the angle $\beta$ of the second inclined plane is strictly greater than the angle $\alpha$ of the first inclined plane.

Referring now to the drawings, the aeraulic separator 1 is more particularly intended for sorting domestic waste collected separately. The particular feature of such a collection resides in a spontaneous distribution by the consumers between different categories of refuse. For example, the consumers may be requested to distribute all their refuse in different skips, for example a skip intended to receive bottles, whether they be of glass or plastic, cardboard, papers, except for organic matters, whilst another skip will be intended to receive said organic matters.

The separator 1 is intended more particularly for sorting non-organic waste. It is constituted by a separation chamber 2 having the general form of a polyhedral case with six faces.

The separation chamber 2 comprises four openings intended for the passage of the materials, namely an inlet opening 3 and three outlet openings 4, 5 and 6.

The function of the separator 1 is to distribute the materials entering in the separation chamber 2 via the inlet opening 3 into three distinct batches, which are evacuated via the three outlet openings 4, 5 and 6 as a function of their weight and shape. More precisely, the heavy materials, particularly glass bottles and compact paper or cardboard objects, for example certain telephone directories, will be evacuated via the first outlet opening 4, whilst the materials of intermediate weight, particularly plastic bottles, less compact paper or cardboard objects, will be evacuated via the second outlet opening 5, whilst the lightest materials such as sheets of paper or plastic films and dust, will be evacuated via the third outlet opening 6.

As shown in FIG. 1, the inlet opening 3 is located in the front lateral face 7 of the chamber and at the bottom thereof. The third outlet opening 6 is located in the upper face 8 of the chamber 2 towards the rear lateral face 9.

Starting from the front lateral face 7, the lower face 10 of the chamber 2 successively comprises a first then a second inclined plane, the first outlet opening 4 over which a first inclined deflector 13 overhangs then, finally, the second outlet opening 5.

The first inclined plane consists in a perforated metal sheet 11 inclined by an angle $\alpha$ with respect to the horizontal. The perforations made in the sheet 11 are holes 22 regularly distributed over the whole surface thereof.

The second inclined plane consists of a perforated metal sheet 12 which is inclined with respect to the horizontal by an angle $\beta$, greater than angle $\alpha$. The perforations made in this second sheet 12 are holes 23 regularly distributed over the whole surface of this second sheet 12.

The first and second inclined planes may, of course, consist of the same perforated metal sheet. In that case, it suffices to have a line of fold to distinguish the two inclined planes 11 and 12.

Below the separation chamber 2, two air admission channels 14, 15 are provided, which open out respectively beneath the first perforated metal sheet 11 for the first channel 14 and beneath the second perforated metal sheet 12 for the second channel 15.

In the example shown in FIG. 1, the two channels 14 and 15 are rigidly fixed to the separation chamber 2 and may be connected by supple connections to an installation for supplying pressurized air.

The first deflector 13 is a solid sheet metal, inclined as shown in FIG. 1, so that, at its front end 16, it substantially overhangs the rear end 17 of the second perforated sheet 12 located in the immediate proximity of the first outlet opening 4. The distance d between the front end 16 of the deflector 13 and the rear end 17 of the second perforated sheet 12 is preferably 150 mm suitable for recovering the heavy materials, such as glass bottles in the first outlet opening 4.

The rear end 18 of the deflector 13 is located in the immediate proximity of the second outlet opening 5.

As is shown in FIG. 1, the third outlet opening 6 is materialized by a conduit 19 acting as stack connected by a supple connection 25 to a suction system 26.

In its preferred version, the assembly constituted by the separation chamber 2 proper and the two air admission channels 14 and 15 is mounted to vibrate at low frequency and high elongation, in the direction of arrows F.

To that end, this assembly is placed on four springs 20 placed in two's on either side of the two lateral faces of the separation chamber, adjacent the front (7) and rear (9) lateral faces, thanks to support tubes **21*a* and 21*b*, fixed rigidly to the two lateral faces and which rest on the springs 20. In each of the tubes 21*a* and 21*b* there rotates an eccentric shaft, driven by brake motors. In FIG. 1, only one front support 21*a* and one rear support 21*b* have been shown, whilst it will be understood that the other two supports (not shown) are placed symmetrically on the other face of the separation chamber 2**.

There are therefore two sets of two spring/support arms, one being located towards the front of the chamber and the other towards the rear of the separation chamber 2. Vibration is obtained by the rotation in opposite direction of two shafts rotating respectively in supports 21*a* and 21*b*. The speed of rotation, the mass and the eccentricity of the shafts as well as the stiffness of springs 20 are determined so that the vibration obtained is of low frequency and high elongation. For example, the elongation is 12 mm and the frequency of the vibrations of the order of 1.2 G. Such vibration makes it possible to obtain advance of the materials deposited on the inclined planes 11 and 12 and a certain aeration of said materials during displacement thereof.

The vibrated aeraulic separator which has just been described operates as follows: The waste is introduced continuously via the inlet opening 3. Said waste moves over the first inclined plane 11, on the one hand, under the action of the vibration and, on the other hand, under the action of the air jets passing through the holes 22. These same air jets lift the waste in disorderly manner, promoting the individualization thereof, in particular the light materials lifted are entrained towards the third outlet opening 6 due to the depression provoked inside the separation chamber 2 by the suction system.

The heavier materials advance to the second inclined plane 12 where they are struck by the air jets coming from holes 23. The materials of intermediate weight are projected, in a trajectory schematically shown by arrow G in the Figure, so that they pass above the first deflector 13 and drop on the upper face thereof. The vibration causes these materials of intermediate weight to move over said deflector 13, up to the second outlet opening 5. As for the heaviest materials, which are not projected above the first deflector 13, they advance until they fall into the first outlet opening 4. The waste introduced via the inlet opening 3 has thus been distributed into three distinct batches of substantially homogeneous weight.

Figure 2:
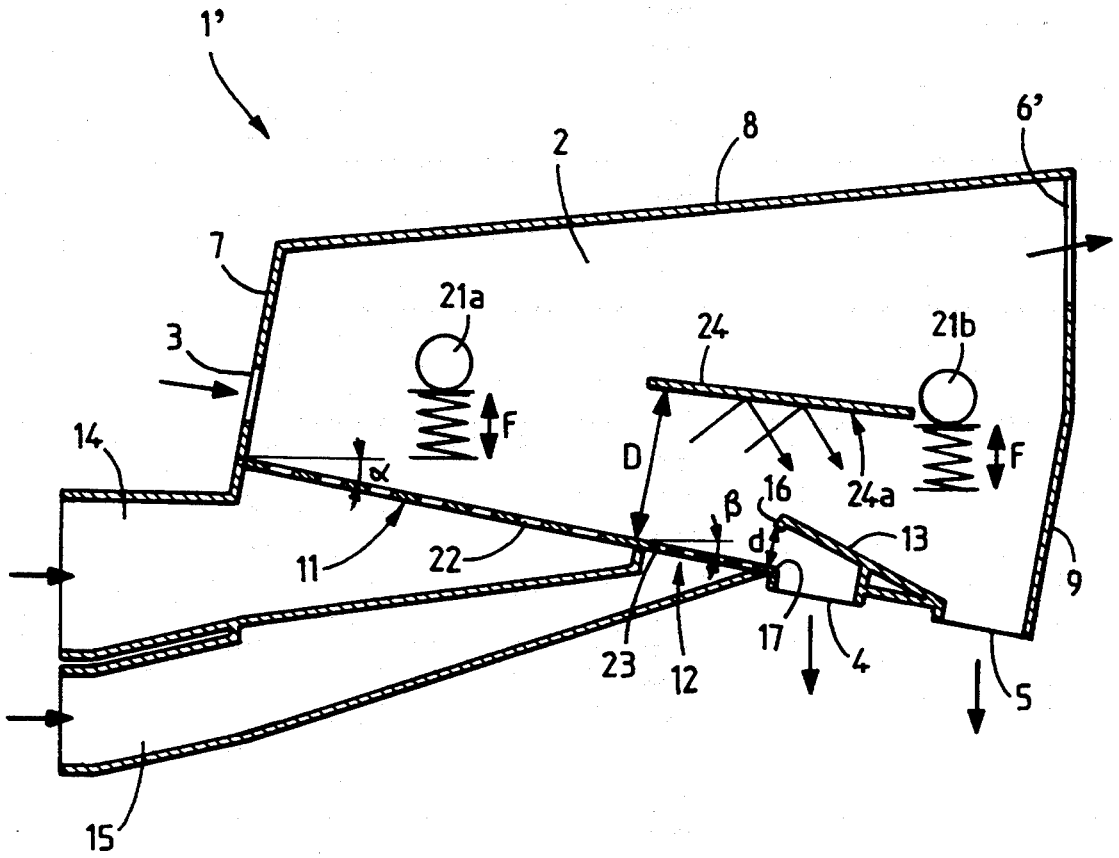
FIG. 2 schematically shows a second particular embodiment of a vibrated aeraulic separator in which angles $\alpha$ and $\beta$ are equal.

FIG. 2 shows an aeraulic separator 1' which is a variant embodiment of the vibrated aeraulic separator 1 described with reference to FIG. 1. To simplify matters, all the elements of the aeraulic separator 1 of FIG. 1 which are found in the aeraulic separator 1' have been indicated in FIG. 2 with the same references.

The aeraulic separator 1' differs from the aeraulic separator 1 principally in that the two inclined planes 11 and 12 have the same inclination, angles As is further apparent in FIG. 2, the third outlet opening, referenced 6', is no longer materialized by a conduit 19 acting as stack, but is made directly in the upper wall of the rear lateral face 9, which is opposite the lateral face 7. Applicants have, in fact, noticed that this arrangement of the third opening 6' provided a better evacuation of the lightest materials.

The aeraulic separator 1' also comprises a second deflector 24, which is constituted by an assembly of plates passing through the separation chamber 2. These plates are positioned substantially horizontally above the second inclined plane 12 and the first outlet opening 4, in an intermediate zone between the first deflector 13 and the third opening 6', the distance D separating the second inclined plane 12 and the lower face 24*a* of the second deflector 24 is preferably of the order of 900 mm. The function of this second deflector 24 is to provide an obstacle to the materials of intermediate weight which might be entrained as far as the third opening 6', after having been lifted by the flow of air passing through the second inclined plane 12. Such a phenomenon has been observed, in the absence of second deflector, with materials of intermediate weight such as plastic bottles. In the aeraulic separator 1', when such materials are lifted by the air flow passing through the second inclined plane 12, they abut against the lower face 24*a* of the second deflector 24, then are redirected towards the upper face of the first deflector 13.

For angles $\alpha$ less than or equal to 9°, it is preferable to use an aeraulic separator of the type shown in FIG. 1, in order to avoid any risk of accumulation of the heaviest materials at the join of the two inclined planes.

On the other hand, for angles $\alpha$ strictly greater than 9°, it is preferable to use an aeraulic separator of the type shown in FIG. 2, which is more simple to produce. In a precise embodiment of the aeraulic separator 1' separating ten tons of waste per hour, the angles $\alpha$ and $\beta$ were 15°; the two inclined planes 11 and 12 were constituted by a single perforated plate of rectangular form, the first and second planes 11 and 12 being rectangles about 1.5 m in length and about 1.2 m and 0.8 m respectively in width; the air suction flowrate via the third opening 6' was 33000 $m^3$/hour, whilst the air admission flowrates in the two channels 14 and 15 were respectively 15500 and 11500 $m^3$/hour; the diameter of the perforations 22 and 23 of the two planes 11 and 12 were of the order of 25 mm; the perforations in each of the two planes 11 and 12 were distributed homogeneously and their number had been calculated so that the velocity of the airflow at the outlet of plane 11 was of the order of 25 m/s, whilst that of the air flow at the outlet of the second plane 12 was about 50 m/s.

The present invention is not limited to the precise embodiment which has just been described. In particular, the first deflector 13 may be mounted to be adjustable, by pivoting about its rear end 18 so as to adjust the distance d as a function of the caliber of the materials to be separated and in particular of the heavy materials to be evacuated via the first outlet opening 4.

Furthermore, in the event of the aeraulic separator not being equipped with vibration means, it may be advantageous to provide the first deflector 13 with specific means allowing the displacement, towards the second outlet opening 5, of the materials dropping on the upper face of said deflector. These specific means may possibly be autonomous vibration means, but may also be pneumatic means projecting said materials forwardly. In the latter case, the first deflector will advantageously be a hollow body whose inner cavity will be supplied with pressurized air and whose upper face will be provided with openings acting as projection nozzles, said openings being, of course, directed in the direction of advance of the matter on the first deflector 13.

The present invention is not limited to the separation of household waste, as has just been described, but may be applied more generally to the separation of materials presenting heterogeneous weight or shape and for which it is desirable to obtain a substantially homogeneous distribution in batches of different weight.

What is claimed is:

1. An aeraulic separator for separating materials into three batches of different weights or shapes, which comprises a separation chamber presenting an upper face, a lower face and four lateral faces and comprising a) in the lower part of a first lateral face, an inlet opening for admission of the materials to be separated, b) in the lower face, successively from said first lateral face up to the opposite lateral face, a first perforated inclined plane with an inclination of angle $\alpha$ with respect to the horizontal, a second perforated inclined plane with an inclination of angle $\beta$ greater than or equal to $\alpha$, a first opening for outlet of the batch corresponding to the heaviest materials, a second opening for outlet of the batch corresponding to the materials of intermediate weight, a first inclined deflector extending above the first outlet opening up to the front edge of the second outlet opening, and c) in the upper part of the separation chamber, towards the zone overhanging the first and second outlet openings, a third opening for outlet of the batch corresponding to the light materials, the third opening connected to a suction system, said separator further comprising two air-supply channels which open out respectively in perforations of the first and second inclined planes, wherein the density and dimensions of the perforations of the first inclined plane, as well as the flowrate of air of the first supply channel are chosen so that air jets through the first inclined plane lift in disorderly manner the materials introduced in the separation chamber promoting the individualization thereof, and making the materials more over the first plane, wherein the density and dimensions of the perforations of the second inclined plane, as well as the flowrate of air of the second supply channel are chosen so that the materials of intermediate weight are projected by the air jets through the second inclined plane above the first deflector and are evacuated via the second outlet opening while the heavier materials are evacuated via the first outlet opening, and wherein the suction system provokes a depression inside the separation chamber so that the light materials lifted by the air jets are entrained through the third outlet opening.

2. The aeraulic separator of claim 1, wherein the density and dimensions of the perforations of the second inclined plane, and the flowrate of air of the second supply channel are chosen so that the velocity of the air jets through the second inclined plane is of the order of 50 m/s.

3. The aeraulic separator of claim 1, wherein the density and dimensions of the perforations of the two inclined planes, and the flowrate of air of the two supply channels are chosen so that the velocity of the air jets through the second inclined plane is about twice the velocity of the air jets through the first inclined plane.

4. The aeraulic separator of claim 1, wherein the angle $\alpha$ of inclination of the first inclined plane and the angle $\beta$ of inclination of the second inclined plane are equal and in the range of 9° to 15°.

5. The aeraulic separator of claim 1, 2, 3 or 4, further comprising a second deflector which is positioned in the separation chamber in the zone which overhangs the second inclined plane and the first outlet opening and which is located between the first deflector and the third outlet opening, so as to form an obstacle to the materials of intermediate weight and to redirect them towards the upper face of the first deflector.

6. The aeraulic separator of claim 1, 2, 3 or 4, wherein the third outlet opening is made in the upper part of the lateral face which is opposite the first lateral face comprising the inlet opening.

7. The aeraulic separator of claim 1, 2, 3 or 4, further comprising vibration means adapted to communicate to the separation chamber a vibration at a low frequency and at high elongation.

8. The aeraulic separator of claim 7, wherein the vibration means consist in springs on which the separation chamber is placed and in eccentric shafts rotating in opposite direction and driven by brake motors, said shafts being fast with the lateral faces of the chamber on either side of the inlet opening.

9. The aeraulic separator of claim 1, 2, 3 or 4, wherein, as the materials to be separated include glass bottles, the front end of the first deflector overhangs the rear end of the second inclined plane at a distance of about 150 mm.

10. The aeraulic separator of claim 1, 2, 3 or 4, wherein the first deflector is of adjustable inclination.

* * * * *